United States Patent [19]

Wrulich et al.

[11] Patent Number: 4,784,439

[45] Date of Patent: Nov. 15, 1988

[54] MOVABLE CUTTING MACHINE

[75] Inventors: Herwig Wrulich; Alfred Zitz, both of Zeltweg; Erich Brandl, Knittelfeld, all of Austria

[73] Assignee: Voest-Alpine Aktiengesellschaft, Vienna, Austria

[21] Appl. No.: 436,438

[22] Filed: Oct. 25, 1982

[30] Foreign Application Priority Data

Nov. 16, 1981 [AT] Austria ..... 4948-81

[51] Int. Cl.[4] ..... E21C 33/00

[52] U.S. Cl. ..... 299/57; 299/64; 198/303

[58] Field of Search ..... 198/303, 864; 299/64, 299/57, 58

[56] References Cited

U.S. PATENT DOCUMENTS

| | | | |
|---|---|---|---|
| 2,796,999 | 6/1957 | Russell | 198/303 |
| 3,279,855 | 10/1966 | Evans | 299/64 |
| 3,621,983 | 11/1971 | Arentzen et al. | 198/303 |
| 4,256,213 | 3/1981 | Shaw et al. | 198/303 |
| 4,281,879 | 8/1981 | Le Beague et al. | 299/64 |
| 4,341,424 | 7/1982 | Wilcox, Jr. et al. | 299/64 |
| 4,363,519 | 12/1982 | Howard | 299/64 |
| 4,377,311 | 3/1983 | Seller | 299/64 |

*Primary Examiner*—Jerome W. Massie, IV
*Assistant Examiner*—William P. Neuder
*Attorney, Agent, or Firm*—Cushman, Darby & Cushman

[57] ABSTRACT

A movable cutting machine is subdivided into a front portion (1) and a rear portion (2) of the cutting machine, which portions are swingable around an approximately vertical pivotal axis (10) and are secured against a relative displacement in direction of this pivotal axis (10) by means of two joints (11, 12). The front portion (1) of the cutting machine has a caterpillar chassis (3) and carries a swivelling means (5) comprising as the cutting means a cutting arm (6) and two cutting heads (7). The rear portion (2) of the cutting machine has, as a support means against ground, equally a caterpillar chassis (4) and carries auxiliary equipment and/or a section of a conveying trough (13) equipped with a chain conveyer.

8 Claims, 2 Drawing Sheets

MOVABLE CUTTING MACHINE

The invention refers to a movable cutting machine comprising a cutting device, particularly formed of a universally swivelling cutting arm arranged on a swivelling means and carrying cutting heads. Such cutting machines have a comparatively great length which is acquired because, on the one hand, reliable stability is required also with high cutting pressures and because, on the other hand,auxiliary equipment must be provided on the cutting machine. If in a usual manner a loading ramp is provided at the front end of the cutting machine for transferring the cut material via a conveyer means, for example a conveyer trough, to the rear end of the cutting machine; and for transferring there the cut material onto the drift conveyer means the loading ramp and the conveyer means imply also a great length of the cutting machine. This great length detracts from the manoeuverability of the cutting machine within the mine. Difficulties are encountered if chambers shall be cut into the rock with usual cutting machines.

It is an object of the invention to improve the manoeuverability of a cutting machine; and the invention essentially consists in that the cutting machine is subdivided into a front cutting machine portion carrying the cutting means and into a rear cutting machine portion carrying auxiliary equipments and/or part of the conveyer means formed, for example,of a conveyer trough, the front cutting machine portion of said cutting machine portions having a chassis, particularly a caterpillar drive, and the rear cutting machine portion being supported against ground or being adapted for being supported against ground, and in that both cutting machine portions are linked one to the other for being swivelled around an approximately vertical swivelling axis and for being secured against relative movement in direction of the vertical swivelling axis. By subdividing the cutting machine into two cutting machine portions the manoeuverability of the cutting machine becomes substantially improved. The individual portions can be substantially shorter than a usual cutting machine. By linking both cutting machine portions in such a manner that these cutting machine portions can be relatively swivelled in a horizontal plane, the turning circle of the cutting machine is substantially diminished, and by securing both cutting machine portions against any relative shift in direction of the vertical swivelling axis, i.e. by preventing both cutting machine portions from any relative shift in height direction at the area of the swivelling axis,the stability is improved in spite of the shortened length. If the cutting arm effects a cutting pressure in upward direction, the rear end of the front cutting machine portion has the tendency to become lifted off the ground and this tendency is increased by the weight of the heavy cantilever cutting arm. Such lifting off ground is, however, counteracted by the rear end of the front cutting machine portion being loaded by the rear cutting machine portion. If the cutting arm effects a cutting pressure in downwards direction, the front end of the front cutting machine portion has the tendency to become lifted off ground. This gives the rear end of the front cutting machine portion, which rearwardly protrudes over the chassis, the tendency to move in downward direction, but the front cutting machine portion is in this case supported on the rear cutting machine portion. Also in this case the stability of the front cutting machine portion is improved.

According to a preferred embodiment of the invention, the rear cutting machine portion is, relative to the front cutting machine portion, also secured against any swivelling movement in vertical direction. This still improves the stability of the cutting machine. Lifting movement of the rear end of the front cutting machine portion when exerting a cutting pressure in upward direction is still better counteracted because the rear end of the front cutting machine portion would, when becoming lifted off ground, have to completely lift off ground and to suspend the rear cutting machine portion, and also lifting movement of the front cutting machine portion is effectively counteracted because in this case the load is transmitted to the rear end of the rear cutting machine portion in view of the front cutting machine portion being incapable of swivelling in height direction independent of the rear cutting machine portion. The cutting machine composed of two cutting machine portions being swivelled only around a vertical axis but not around a horizontal axis is thus, in consideration of the stability, an equivalent of a cutting machine having a length corresponding to the length of both cutting machine portions, while, in view of the vertical swivelling axis, only the length of one cutting machine portion is determinative of the manoeuverability and of the turning circle.

According to the invention a swivelling drive, particularly a hydraulic swivelling drive, is provided for the relative swivelling movement of both cutting machine portions around the vertical swivelling axis. This can, according to the invention, be achieved in such a manner that at the side of the vertical swivelling axis of the cutting machine portions, at least at one side of said portions, a hydraulic or pneumatic cylinder-piston-aggregate is provided. In this manner both cutting machine portions can positively be swivelled in horizontal direction relative one to the other.

According to the invention, the rear cutting machine portion can be provided with a chassis, particularly a caterpillar chassis, which has a drive being independent of the chassis of the front cutting machine portion. In this case, the cutting machine represents a vehicle being capable of being inked around a vertical axis,the turning circle of the vehicle being diminished by such kink. According to a preferred embodiment of the invention, the rear cutting machine portion is, however, suspended on the front cutting machine portion and has at least one upwardly and downwardly movable supporting means for supporting on ground. This still improves the manoeuverability of the cutting machine. For example, said both cutting machine portions can, with the supporting means being lowered, be swivelled one relative to the other in the horizontal plane by means of the swivelling drive. If subsequently the supporting means of the rear portion of the cutting machine is lifted off ground, the rear portion of the cutting machine can be swivelled relative to the front portion of the cutting machine by means of the swivelling drive in the other direction and in the horizontal plane, whereupon the supporting means can again be lowered to ground. In this manner, the cutting machine can, so to say, walk laterally and this is of particular importance if both cutting machine portions are standing beside a wall and can no more be correctly manoeuvered in another manner.

According to the invention, the arrangement is preferably such that both cutting machine portions carry one section of a conveying means formed of a conveying trough or the like and that the section of the conveying trough or the like carried by the rear portion of the cutting machine is connected with the section of the conveying trough or the like carried by the front portion of the cutting machine for being laterally swingable around an upright pivoting axis. In this manner, also the conveying trough can be kinked in an approximately horizontal plane, i.e. in an analogous manner both cutting machine portions can be swivelled around a vertical pivoting axis . Such conveying troughs or the like being composed of two relatively swingable sections are known as to serve the purpose to laterally displace the discharge end of the conveying trough or the like. In the present case, the swingability within an approximately horizontal plane serves the purpose to improve the manoeuverability. With such known conveying troughs or the like being kinkable in a horizontal plane, kinking is only possible around an axis extending perpendicularly relative to the surface of the conveying trough or the like. However,according to the invention, the section of the conveying trough or the like carried by the front portion of the cutting machine is subdivided into two portions being swingable one relative to the other around a horizontal axis, so that in this manner also the slope of the conveying trough or the like can be changed, what means in other words that also the discharge end of the conveying trough or the like can be displaced in height direction. In this case, said horizontal axis is conveniently located in back of the swivelling drive of the cutting arm. The conveying trough or the like is, as a rule, arranged in the mid-portion of the cutting machine and passed below the swivelling drive which is given a tunnel-shape. The height of this tunnel is limited by the over-all height, but must, however, be such that bigger lumps become not jammed within the tunnel. In view of said horizontal swivelling axis being located in back of the swivelling drive, the front portion of the section of the conveying trough or the like carried by the front portion of the cutting machine remains always at the same height within the tunnel and the rear portion of this section of the conveying trough or the like is only lifted at the location behind the horizontal swivelling axis.

Preferably, the section of the conveying trough or the like carried by the rear portion of the cutting machine is supported against the rear portion of the cutting machine by at least one length-adjustable, particularly hydraulic strut being connected with the conveying trough or the like and optionally with the rear portion of the cutting machine by crowned bearings. By means of this length-adjustable strut, the section of the conveying trough or the like carried by the rear portion of the cutting machine can be lifted together with that portion of the section of the conveying trough or the like carried by the front portion of the cutting machine which is located behind said horizontal axis. The rear portion of the cutting machine is, however, swivelled around a vertical axis while the rear section of the conveying trough is swivelled around an axis extending perpendicularly relative to the upwardly inclined conveying trough which axis does not exactly coincide with that vertical axis around which the rear portion of the cutting machine is swivelled. During lateral swivelling movement, the rear section of the conveying trough is thus twisted which is taken in consideration by the crowned bearings.

In a constructively favorable embodiment of the invention, both cutting machine portions are mutually linked one to the other by means of two joints located one above the other with a certain distance. By the vertical distance of these two joints, the strength of the pivotal joint against kinking around a horizontal axis is substantially increased. The conveying trough or the like may be passed between these two joints located one above the other with a certain distance.

According to the invention, the swivelling drive can be arranged approximately on the mid-portion of the front portion of the cutting machine and the length of the front portion of the cutting machine need not substantially exceed the length of this swivelling drive.

In the drawing, the invention is schematically illustrated with reference to embodiment.

Figure 1:
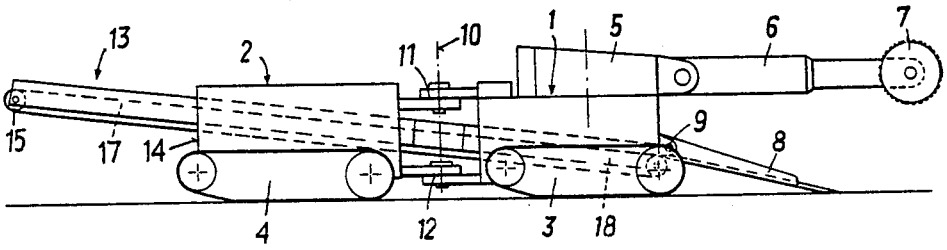
FIGS. 1 and 2 show one embodiment of the cutting machine FIG. 1 showing a side elevation and FIG. 2 showing a top-plan view.
Figure 2:
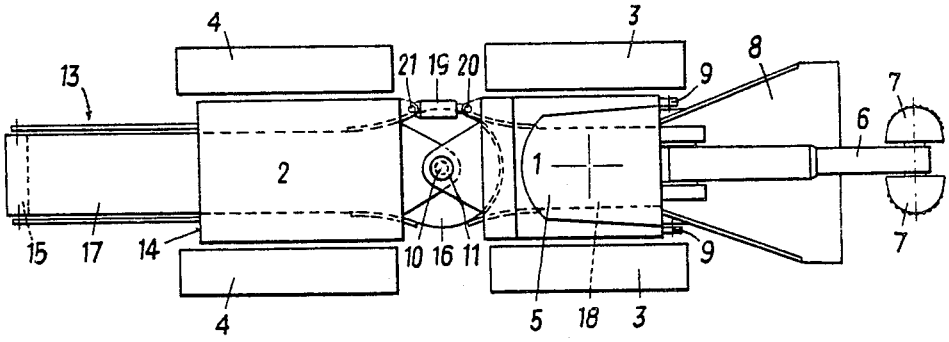

The cutting machine according to FIGS. 1 and 2 is subdivided in two portions, i.e. a front portion 1 of the cutting machine and a rear portion 2 of the cutting machine, both cutting machine portions carrying a caterpillar drive 3 and, respectively 4, provided with a drive means. A swivelling drive 5 is arranged on the front portion 1 of the cutting machine and is carrying a cutting arm 6 being provided with two cutting heads 7. A usual loading ramp 8 is also arranged on the portion 1 of the cutting machine for being lifted and lowered around an axis 9.

The front portion 1 of the cutting machine has a very short length and the length of this front portion 1 of the cutting machine is substantially shorter than the length of a usual cutting machine. As is shown in the drawing, the length of the front portion 1 of the cutting machine does not exceed or not substantially exceed the length of the swivelling drive 5. The stability of this front portion of the cutting machine would thus be insufficient in view of the weight of the cantilever cutting arm 6 and in view of the cutting pressure applied. The rear portion 2 of the cutting machine is now linked to the front portion 1 of the cutting machine for being swivelled around a vertical axis 10. The swivelling axis is formed of two joints 11 and 12 located at a certain distance one above the other. In view of the great vertical distance between both joints 11 and 12, the connection is given a great stiffness against any swivelling movement around a horizontal axis, so that both cutting machine portions 1 and 2 are, in practice, rigidly connected in vertical direction. Tilting forces exerted by the cutting forces and by the weight of the cutting arm 6 and tending to tilt the cutting machine portion 1 around a horizontal transverse axis are thus fully received by the rear portion 2 of the cutting machine. Pivoted connection around the vertical swivelling axis 10 provides, however, the possibility to kink the whole cutting machine in a horizontal plane so that curves of small radius of curvature can be travelled upon and the manoeuverability of the cutting machine is substantially improved.

A conveying rough 13 protrudes over the rear end 14 of the rear portion 2 of the cutting machine and is provided with a chain conveyer or scraper conveyer not shown, and is conveying the cut material from the loading ramp 8 in backward direction. A chain star 15 is provided at the rear end. This chain conveyer is now passed between the upper joint 11 and the lower joint 12 so that said both joints can be arranged with a great distance one from the other, thus increasing the stiffness of the pivotal joint of both cutting machine portions 1 and 2 against kinking around a horizontal axis. In the area of the pivotal axis 10, the conveying trough has a joint 16, the vertical axis of which joint approximately coinciding with the vertical pivotal axis 10. Thus, the rear section 17 of the conveying trough is swingable relative to the front section 18 of the conveying trough in similar manner as is the rear portion 2 of the cutting machine relative to the front portion 1 of the cutting machine.

A hydraulic cylinder-piston-aggregate 19 is linked at 20 to the front portion 1 of the cutting machine and linked at 21 to the rear portion 2 of the cutting machine. This piston-cylinder-aggregate 19 is arranged at a lateral distance from the vertical pivotal axis 10 so that by lengthening and shorting this cylinder-piston-aggregate the rear portion of the cutting machine can be swivelled around the vertical pivotal axis 10 relative to the front portion of the cutting machine thereby facilitating the dirigibility of the cutting machine.

The front section 18 of the conveying trough is carried by the front portion 1 of the cutting machine . The rear section 17 of the conveying trough is carried by the rear portion of the cutting machine. Moreover, all necessary auxiliary equipments (not shown) are arranged on the rear portion of the cutting machine.

Figure 3:
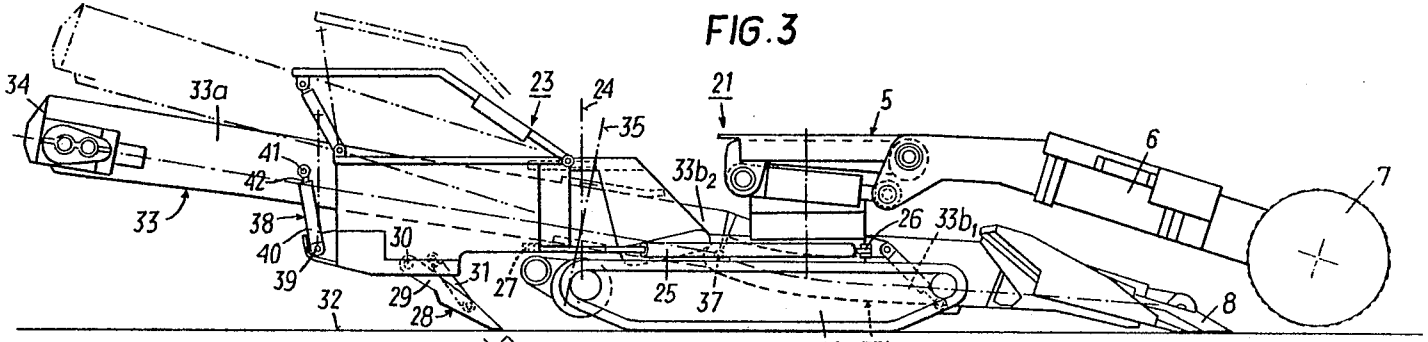
FIGS. 3 and 4 show another embodiment of the cutting machine, FIG. 3 showing a side elevation and FIG. 4 showing a top-plan view.
Figure 4:
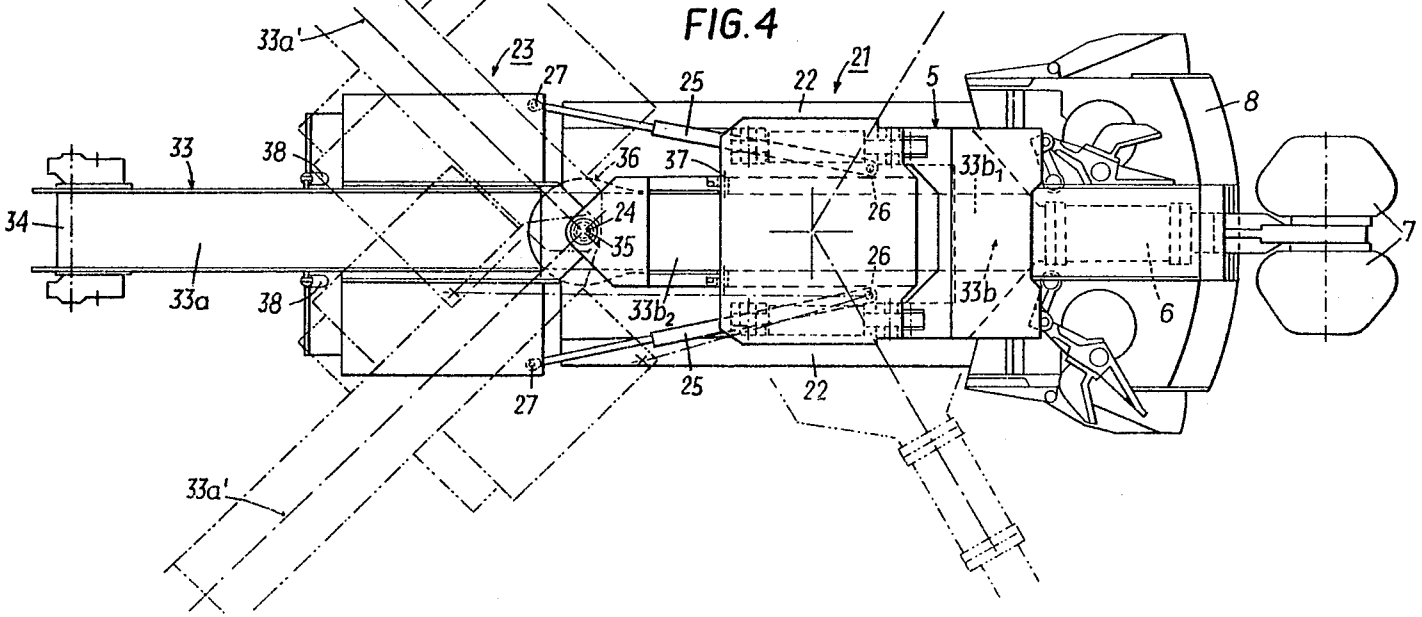

In the embodiment according to FIGS. 3 and 4, only the front portion 21 of the cutting machine is equipped with a caterpillar chassis 22. The rear portion 23 of the cutting machine is suspended on the front portion 21 of the cutting machine in a cantilevering manner and for being swingable around a vertical pivotal axis 24. At both sides of this pivotal axis, one hydraulic-piston-aggregate 25 each is linked at 26 to the front portion 21 of the cutting machine and at 27 to the rear portion 23 of the cutting machine. These cylinder-piston-aggregates 25 represent the swivelling drive by means of which the rear portion 23 of the cutting machine can be swivelled in horizontal direction relative to the front portion 21 of the cutting machine. 28 is a supporting means which is linked at 30 to the rear portion 23 of the cutting machine by means of a guide rod 29. This supporting means can be lowered to ground 32 by means of a piston-cylinder-aggregate 31. In lowered position,in which the supporting means 28 is supported against ground, the effective length of the cutting machine is increased so that the required stability is warranted in spite of the small longitudinal dimension of the front portion 21 of the cutting machine. The swivelling means 5 carries in usual manner the cutting arm 6 which is equipped with cutting heads 7. 8 is the loading ramp. The vertical pivotal axis 24 is designed in analogous manner as in the arrangement according to FIGS. 1 and 2.

The cut material is conveyed from the loading ramp via a conveying trough 33 to the discharge end 34 thereof. The conveying trough 33 has a rear section **33*a* supported on the rear portion 33 of the cutting machine. This rear section of the conveying trough is connected with the front section 33*b* of the conveying trough for being horizontally swingable around an axis 35. The swivelling area of the conveying trough is designated 36. The axis 35, around which the conveying trough can approximately horizontally be swivelled is in normal position relative to the surface of the sections 33*a* and 33*b* of the conveying trough and is located within the area of the vertical pivotal axis 24. The rear section 33*a* of the conveying trough can thus be swivelled around this axis 35 in right-hand direction and in left-hand direction, the limit positions being indicated by the central lines 33*a*'. The rear section 33*a* of the conveying trough can be swivelled around the axis 35** only in its plane, but not in height direction.

For providing the possibility to displace the discharge end 34 of the conveying trough in height direction, the front section **33*b* of the conveying trough is again subdivided into two portions, i.e. into the portions $33b_1$ and $33b_2$. These two portions $33b_1$ and $33b_2$ of the conveying trough are pivotally connected one with the other for swinging movement around a horizontal axis 37, the portion $33b_1$ of the conveying trough being stationarily arranged on the front portion 21 of the cutting machine while the rear portion $33b_2$ carries the pivotal axis 35 and is thus rigidly connected in height direction with the rear section 33*a*** of the conveying trough.

The rear section **33*a* of the conveying trough is supported against the rear portion 23 of the cutting machine by means of a length-adjustable hydraulic strut 38. The cylinder 40 of the hydraulic strut 38 is linked to the rear portion 23 of the cutting machine by means of a bolt 39 while the piston rod 42 is linked to the rear section 33*a* of the conveying trough by means of a bolt 41. In view of the axis 35, around which the section 33*a* of the conveying trough is laterally swingable relative to the portion $33b_2$ of the conveying trough, extending perpendicularly to the surface of the section 33*a* and the portion $33b_2$ of the conveying trough, this axis 35 does not coincide with the axis 24 around which the rear portion of the cutting machine is swingable relative to the front portion of the cutting machine and this results during lateral swinging movement in obliquely positioning in transverse direction the section 33*a* of the conveying trough. For compensating this condition, at least the joint 41** can be crowned.

We claim:

1. A movable articulated cutting machine comprising front and rear carriage assemblies pivotably connected to each other and capable of swivelling in an essentially horizontal plane about a vertical axis and being secured against relative pivotal movement in the vertical direction, drive means for swivelling the front and rear carriage assemblies about the vertical axis, each of the carriage assemblies being provided with a pair of independently operated power driven endless tract units, the front carriage portion carrying a universally swivelling cutting arm arranged on a swivelling means and carrying at least one horizontally rotating cutting head transverse to the arm and capable of cutting in the upward and downward directions thereby exerting an upward and downward force respectively on the rear carriage, the rear carriage assembly carrying auxiliary equipment, a conveyor trough having a receiving end located about the front carriage assembly and a discharge end located about the rear carriage assembly, the conveyor trough being articulated about a vertical axis located between the receiving and discharge ends whereby the rear carriage assembly and conveyor section are pivotable with respect to the front carriage assembly and conveyor section about the vertical axis, and the section of the conveyor trough carried by the front portion of the cutting machine being subdivided into two portions which are swingable one relative to the other around a horizontal axis.

2. A cutting machine as in claim 1 wherein said horizontal axis is located in back of the swivelling drive of the cutting arm.

3. A movable articulated cutting machine comprising front and rear carriage assemblies pivotally connected to each other and capable of swivelling in an essentially horizontal plane about a vertical axis and being secured against relative pivotal movement in the vertical direction, drive means for swivelling the front and rear carriage assemblies about the vertical axis, each of the carriage assemblies being provided with a pair of independently operated power driven endless track units, the front carriage portion carrying a universally swivelling cutting arm arranged on a swivelling means and carrying at least one horizontally rotating cutting head transverse to the arm and capable of cutting in the upward and downward directions whereby exerting an upward and downward force respectively on the rear carriage, the rear carriage assembly carrying auxiliary equipment, a conveyor trough having a receiving end located about the front carriage and a discharge end located about the rear carriage assembly, the conveyor trough being articulated about a vertical axis located between the receiving and discharge ends whereby the rear carriage and conveyor section are pivotable with respect to the front carriage and conveyor section about the vertical axis, and the section of the conveyor trough carried by the rear portion of the cutting machine being supported against the rear portion of the cutting machine by at least one length adjustable hydraulic strut connected with the conveyor trough and with the rear portion of the cutting machine by crowned bearings.

4. A movable articulated cutting machine comprising front and rear carriage assemblies pivotally connected to each other and capable of swivelling in an essentially horizontal plane about a vertical axis and being secured against relative pivotal movement in the vertical direction, drive means for swivelling the front and rear carriage assemblies about the vertical axis, each of the carriage assemblies being provided with a pair of independently operated power driven endless track units, the front carriage portion carrying a universally swivelling cutting arm arranged on a swivelling means and carrying at least one horizontally rotating cutting head transverse to the arm and capable of cutting in the upward and downward directions thereby exerting an upward and downward force respectively on the rear carriage, the rear carriage assembly carrying auxiliary equipment, a conveyor trough having a receiving end located about the front carriage and a discharge end located about the rear carriage assembly, the conveyor trough being articulated about a vertical axis located between the receiving and discharge ends whereby the rear carriage and conveyor section are pivotable with respect to the front carriage and conveyor section about the vertical axis, and the front and rear cutting machine assemblies being linked together by two linkages located one above the other with the conveyor trough passing between the linkages.

5. A movable articulated cutting machine comprising front and rear carriage assemblies pivotally connected by at least one linkage means, whereby the carriage assemblies may swivel about an essentially vertical axis with respect to one another while resisting any pivotal movement about a horizontal axis, drive means for actuating movement between the carriage assemblies, the front carriage assembly having a pair of power driven endless track units and carrying a universally mounted cutting arm having at least one horizontally rotating cutting head transverse to the cutting arm capable of cutting in the upward and downward directions thereby exerting upward and downward forces on the rear carriage, a conveyor extending from the front to rear ends of the cutting machine, the conveyor being articulated about a vertical axis in the vicinity of the linkage between the front and rear carriage assemblies, the rear carriage capable of carrying auxiliary equipment and further having an extendable ground engaging support means, and the section of the conveyor trough carried by the front portion of the cutting machine being subdivided into two portions which are swingable one relative to the other around a horizontal axis.

6. A cutting machine as in claim 5 wherein said horizontal axis is located in back of the swivelling drive of the cutting arm.

7. A movable articulated cutting machine comprising front and rear carriage assemblies pivotally connected by at least one linkage means, whereby the carriage assemblies may swivel about an essentially vertical axis with respect to one another while resisting any pivotal movement about a horizontal axis, drive means for actuating movement between the carriage assemblies, the front carriage assembly having a pair of power driven endless track units and carrying a universally mounted cutting arm having at least one horizontally rotating cutting head transverse to the cutting arm capable of cutting in the upward and downward directions thereby exerting upward and downward forces on the rear carriage, a conveyor extending from the front to rear ends of the cutting machine, the conveyor being articulated about a vertical axis in the vicinity of the linkage between the front and rear carriage assemblies, the rear carriage capable of carrying auxiliary equipment and further having an extendable ground engaging support means, and the section of the conveyor trough carried by the rear portion of the cutting machine is supported against the rear portion of the cutting machine by at least one length-adjustable hydraulic strut connected with the conveyor trough and with the rear portion of the cutting machine by crowned bearings.

8. A movable articulated cutting machine comprising front and rear carriage assemblies pivotally connected by at least one linkage means, whereby the carriage assemblies may swivel about an essentially vertical axis with respect to one another while resisting any pivotal movement about a horizontal axis, drive means for actuating movement between the carriage assemblies, the front carriage assembly having a pair of power driven endless track units and carrying a universally mounted cutting arm having at least one horizontally rotating cutting head transverse to the cutting arm capable of cutting in the upward and downward directions thereby exerting upward and downward forces on the rear carriage conveyor, a conveyor extending from the front to rear ends of the cutting machine, the conveyor being articulated about a vertical axis in the vicinity of the linkage between the front and rear carriage assemblies, the rear carriage capable of carrying auxiliary equipment and further having an extendable ground engaging support means, the front and rear cutting machine assemblies being linked together by two linkages located one above the other with the conveyor trough passing between the linkages.

* * * * *